US012442150B2

(12) United States Patent
Mayinger et al.

(10) Patent No.: US 12,442,150 B2
(45) Date of Patent: Oct. 14, 2025

(54) DRILLING TOOL AND METHOD FOR CREATING A BORE IN THE GROUND

(71) Applicant: BAUER Spezialtiefbau GmbH, Schrobenhausen (DE)

(72) Inventors: Matthias Mayinger, Rennertshofen (DE); Andreas Stimpfle-Ziegler, Kühbach (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 109 days.

(21) Appl. No.: 18/568,052

(22) PCT Filed: May 25, 2022

(86) PCT No.: PCT/EP2022/064200
§ 371 (c)(1),
(2) Date: Dec. 7, 2023

(87) PCT Pub. No.: WO2022/258379
PCT Pub. Date: Dec. 15, 2022

(65) Prior Publication Data

US 2024/0271382 A1 Aug. 15, 2024

(30) Foreign Application Priority Data

Jun. 8, 2021 (EP) ..... 21178238

(51) Int. Cl.
*E02D 3/12* (2006.01)
*E02D 7/22* (2006.01)
*E02D 7/24* (2006.01)

(52) U.S. Cl.
CPC ..... *E02D 3/126* (2013.01); *E02D 7/22* (2013.01); *E02D 7/24* (2013.01)

(58) Field of Classification Search
CPC .. E02D 15/04; E02D 7/22; E02D 7/24; E02D 3/126
See application file for complete search history.

(56) References Cited

U.S. PATENT DOCUMENTS 3,802,208 A * 4/1974 Granholm ..... E02D 3/12 175/324
3,949,561 A * 4/1976 Chapman ..... E02D 3/12 405/266

(Continued)

FOREIGN PATENT DOCUMENTS

DE 10 2004 005 967 A1 9/2005
EP 0 441 169 A2 8/1991

(Continued)

OTHER PUBLICATIONS

International Search Report issued in PCT/EP2022/064200; mailed Sep. 19, 2022.

(Continued)

*Primary Examiner* — Janine M Kreck
(74) *Attorney, Agent, or Firm* — Studebaker Brackett PLLC

(57) ABSTRACT

The invention relates to a drilling tool for creating a bore in the ground, having a tubular drill shank, at least one removal device which is configured to remove ground material, a supply device for supplying a fluid through the drill shank through at least one outlet opening for the fluid into the bore and at least one mixing element which extends radially to the drill shank, is arranged on the drill shank above the removal device and is configured to mix ground material with the fluid. According to the invention, it is provided that at least one first outlet opening is arranged in the region of the removal device and at least one second outlet opening is arranged at an axial distance from the at least one first outlet opening and at least one actuating device is provided on the (Continued)

Figure 1:
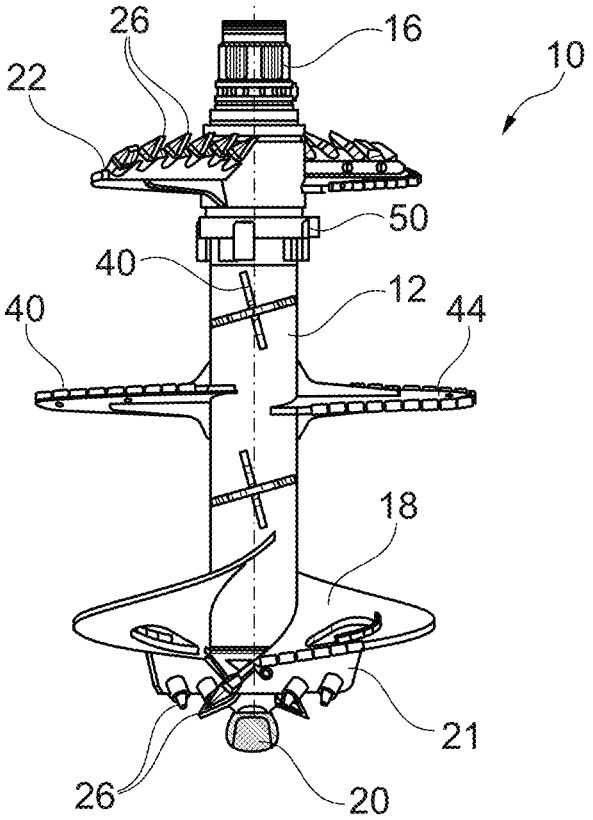

supply device, by means of which the at least one first outlet opening and/or the at least one second outlet opening can be blocked, wherein fluid can optionally be introduced into the bore via the at least one first outlet opening and/or the at least one second outlet opening.

13 Claims, 2 Drawing Sheets

(56) References Cited

U.S. PATENT DOCUMENTS

| | | | | |
|---|---|---|---|---|
| 5,304,016 | A | 4/1994 | Kunito | |
| 5,439,147 | A * | 8/1995 | Bitschnau | B28B 13/02 222/413 |

FOREIGN PATENT DOCUMENTS

| | | | |
|---|---|---|---|
| EP | 2 156 907 | A1 | 2/2010 |
| WO | 2015/140468 | A1 | 9/2015 |

OTHER PUBLICATIONS

International Preliminary Report on Patentability (Chapter II) issued in PCT/EP2022/064200; completed Oct. 5, 2023.

* cited by examiner

DRILLING TOOL AND METHOD FOR CREATING A BORE IN THE GROUND

The invention relates to a drilling tool for creating a bore in the ground, having a tubular drill shank, at least one removal device which is configured to remove soil material, a supply device for supplying a fluid through the drill shank through at least one outlet opening for the fluid into the bore and at least one mixing element extending radially to the drill shank, which is arranged on the drill shank at an axial distance from the removal device and is configured for mixing soil material with the fluid, according to the preamble of claim 1.

The invention further relates to a method for creating a bore in the ground according to the preamble of claim 12.

Generic drilling tools are used in particular in special heavy construction to create foundation elements in the ground. The drilling tool can be configured with a drilling auger, for example, which is sunk-by-drilling into the ground while removing soil material. The soil material crushed by a removal device on the auger can be conveyed upwards into an upper area of the bore. During drilling, a curable suspension can be introduced via an outlet opening on the drill shank, wherein the suspension is mixed with the crushed soil material by means of mixing elements on the drill shank to produce a so-called soil mortar in situ. After reaching a total depth, the drilling tool is pulled out of the bore again, wherein a finished soil mortar is produced, if necessary, with a further supply of drilling suspension and rotation of the drilling tool for further mixing, which can then cure for becoming the foundation element.

For a particularly good mixing result, it is known to provide at least one radially directed conduit channel on the drill shank, so that suspension can be introduced over a larger diameter area into the bore.

The object underlying the invention is to specify a drilling tool and a method for creating a bore in the ground, by means of which a particularly good introduction of fluid into the bore can be achieved.

The object is achieved, on the one hand, by a drilling tool having the features of claim 1 and, on the other hand, by a method having the features of claim 12. Preferred embodiments of the invention are indicated in the dependent claims.

The drilling tool according to the invention is characterized in that at least one first outlet opening is arranged in the region of the removal device and at least one second outlet opening is arranged at an axial distance from the at least one first outlet opening, and in that at least one actuating device is provided on the supply device, by means of which the at least one first outlet opening and/or the at least one second outlet opening can be blocked, wherein fluid can optionally be introduced into the bore via the at least one first outlet opening and/or the at least one second outlet opening.

A first basic idea of the invention is to provide multiple outlet openings along the drill shank. It is a further basic idea of the invention that an actuating device is provided by means of which at least one outlet opening can be optionally blocked. With the drilling tool according to the invention, it is thus possible to introduce fluid into the bore in a controlled manner at specific times via specific outlet openings.

For example, fluid can be introduced in the area of the removal device during sinking-by-drilling so that the removed cuttings can be admixed with the fluid, in particular a drilling suspension, directly at the removal device. This enables a particularly good mixing result to be achieved already during sinking-by-drilling. When the drill shank is withdrawn from the borehole, a further supply of drilling suspension in the area of the removal device can impair a mixing result, as drilling suspension, which is introduced into the borehole at the lower end of the drilling tool, can hardly be mechanically mixed when the drilling tool is pulled upwards.

With the drilling tool according to the invention, for example, lower first outlet openings can be blocked via the actuating device, while a further supply of suspension can take place via axially spaced upper second outlet openings. When the still rotating drilling tool is retracted, the suspension introduced at the top can be further admixed with the removed soil material by the drilling tool with arranged mixing elements and/or the removal device. In this way, a particularly good mixture and, in particular, a high-quality and very uniform soil mortar can be efficiently produced. In this way, particularly strong foundation elements can be produced in the ground.

In principle, a wide variety of constellations for supplying a fluid into a bore can be set using the at least one actuating device. For example, a supply can only take place via individual outlet openings or simultaneously via multiple outlet openings. A particularly advantageous embodiment of the invention is that the at least one first outlet opening and the at least one second outlet opening can alternately be blocked by the at least one actuating device, wherein fluid can be introduced into the bore via the at least one first outlet opening and/or the at least one second outlet opening, while the at least one second outlet opening or rather the at least one first outlet opening is blocked. Switchable blocking can ensure that fluid is not conducted simultaneously via two axially spaced outlet openings. The fluid can be a flowable medium, in particular a liquid or a suspension.

In general, the drilling tool can have a removal device for removing soil material only at its lower end portion. In certain soil conditions, it may be appropriate according to a further development of the invention that least one first removal device is arranged at a lower end portion of the drill shank and at least one second removal device is arranged axially above the first removal device. In this way, the second removal device can be provided at an upper end portion of the drilling tool, so that, where necessary, any soil material that has fallen in during retraction of the drilling tool can also be reliably removed along the borehole wall. The outlet openings are preferably located at and/or between the two removal devices.

It is particularly appropriate for the at least one mixing element to be arranged between the first removal device and the second removal device. In this way, soil material removed by both removal devices can be reliably mixed by means of the mixing device both during sinking-by-drilling and during retraction. Preferably, multiple mixing elements are arranged along the drill shank.

According to a further embodiment variant of the invention, a particularly good mixing result can be achieved in that the removal device has at least one support bar extending radially to the drill shank, on which removal elements for removing soil material are arranged, and in that a first conduit channel is formed on or in the support bar, along which one or multiple outlet openings are provided. In this way, fluid can be introduced via the support bar of the removal device distributed over the diameter of the bore. This ensures particularly good distribution and stirring.

A particularly good mixing result can also be achieved according to another embodiment of the invention in that the mixing element has a support arm and in that a second conduit channel is formed on or in the support arm, along which one or multiple outlet openings are provided. The mixing element can be formed only of the support arm or of additional stirring or mixing members on the support arm. A support arm of the at least one mixing element extending in a radial direction away from the drill shank can also take place good distribution and mixing across the bore diameter.

Another preferred embodiment of the invention is that at least one outlet opening is arranged directly on the drill shank. In particular, one or multiple outlet openings can be provided at the lower end portion of the drill shank close to the removal device, since particularly strong mixing occurs there due to the mechanical energy input.

In principle, the actuating device can be configured in any suitable way, for example with electrically controllable control valves. A particularly appropriate embodiment of a drilling tool according to the invention is that the actuating device comprises at least one movable actuating element which can be adjusted between a closed setting and an open setting. The actuating elements can be flaps or spools, which can be controlled individually by actuators or mechanically by a central actuating linkage.

In general, one or multiple actuating elements can be arranged centrally in the drill shank so that, for example, a passage to a lower area of the drill shank is provided to be opened or released. The actuating element can thereby block or release a passage channel in the drill shank. According to a further development of the invention, it is particularly advantageous that an actuating element is assigned to each conduit channel. In this way, it is possible to set whether or not fluid is to be introduced with the radially directed conduit channels. An actuating element can also be used to block or open a part of the drill shank.

A particularly reliable activation of the at least one actuating element by the actuating device can be achieved by the fact that the actuating device can be operated by changing the rotation of the drill shank. In this way, a simple and robust design of the drilling tool can be achieved furthermore.

In particular, this can be achieved by the fact that the at least one actuating element is mechanically adjustable by means of a link adjusting mechanism. For example, a mechanical control link can be provided along the drill shank, along which an operating element or an operating cam of the actuating element lies against and is guided. By changing the rotation of the drill shank, the actuating element with the actuating cam can be displaced along the link, wherein the actuating element can assume the closed setting on the one hand or the open setting on the other hand. This enables simple mechanical control to be achieved. In particular, during sinking-by-drilling with a predetermined direction of rotation, the at least one lower outlet opening can be opened, whereas when the drilling tool is withdrawn out of the borehole in the opposite direction of rotation, the at least one lower outlet opening is automatically closed by the predetermined link adjusting mechanism.

The invention further relates to a method for creating a bore in the ground, wherein the drilling tool according to the invention described above is used and a fluid is optionally introduced into the bore via at least one first outlet opening and/or at least one second outlet opening.

With the method according to the invention, the advantages described above can be achieved when using the drilling tool according to the invention.

In particular when using a curable liquid or suspension, an expedient method variant can be implemented in that the fluid is introduced during sinking-by-drilling via the at least one first outlet opening, which is arranged in a lower end portion of the drill shank, and that the fluid is introduced into the bore via the at least one second outlet opening above the first outlet opening, wherein the drilling tool is rotated. This method can be used in particular to produce a high-quality soil mortar in the bore.

According to a further development of the method according to the invention, it is particularly expedient that a curable suspension is introduced as the fluid, wherein a foundation element is produced in the ground in the bore. After the retraction of the drilling tool, the soil mortar produced in the bore from the removed soil material and the curable fluid fed can cure to form a foundation element, in particular a foundation pile.

The method according to the invention can thus produce a particularly well-mixed ground mortar and therefore very homogeneous ground mortar, which cures to form a high-quality foundation element. The risk of forming defects in the foundation element is considerably reduced or even completely prevented.

Figure 2:
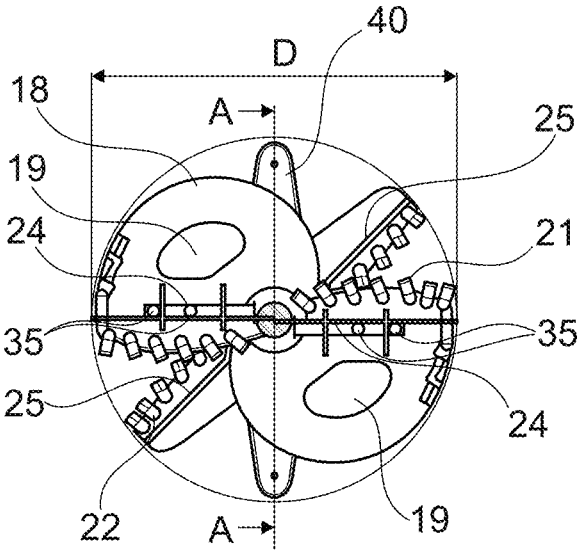
Figure 3:
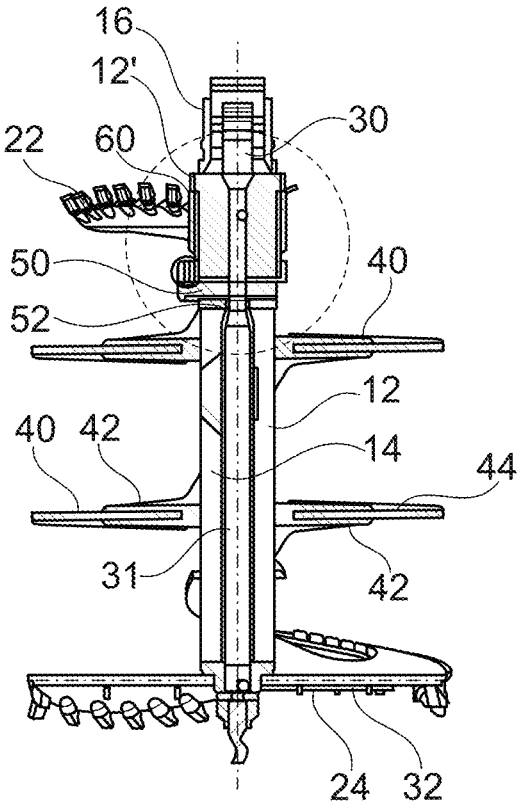
Figure 4:
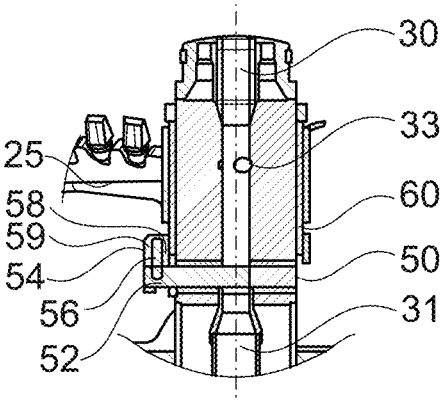

The invention is explained further below with reference to a preferred exemplary embodiment. The drawings show in:

FIG. 1 a side view of a drilling tool according to the invention;

FIG. 2 a view of the drilling tool in FIG. 1 from below;

FIG. 3 a cross-sectional view of the drilling tool according to FIGS. 1 and 2; and FIG. 4 an enlarged detailed view corresponding to the marked detail in FIG. 3 of the actuating device of a drilling tool according to the invention.

A drilling tool 10 according to the invention is explained in conjunction with FIGS. 1 to 4. The drilling tool 10 comprises a tubular drill shank 12 with an inner cavity 14. A central pilot tip 20 and a downwardly directed first removal device 21 are arranged on an underside of the drill shank 12. The first removal device 21 has a short drill helix 18 with two passage openings 19. Tooth-like removal elements 26 for removing soil material are arranged along two first support bars 24 extending in a radial direction in a manner known per se. The first support bars 24 are designed hollow and form a first conduit 32, which extends in a radial direction. The first conduit 32 is connected to a central supply device 30 with a central conduit 31 in the hollow drill shank 12 for supplying a liquid or suspension. The liquid or suspension can flow out along the first support bars 24 via first outlet openings 35.

A plug-like drill pipe connection 16 is arranged at an upper end of the drill shank 12, in order to connect the drilling tool 10 to a hollow drill pipe, not shown, which is rotatably mounted and driven in a manner known per se on a preferably mobile drilling rig. Liquid or suspension can be fed from the drilling rig via the drill pipe to the supply device 30 in the drilling tool 10.

Directly below the drill pipe connection 16 is arranged an upward-directed second removal device 22 with tooth-like removal elements 26. In contrast to the removal elements 26 of the first removal device 21, the removal elements 26 of the second removal device 22 are directed upwards, in order to crush soil material that maybe have fallen in during rotatingly withdrawing of the drilling tool 10 from a created borehole and to ensure a reliable withdrawing of the drilling tool out of a bore in the ground.

The second removal device 22 can also have two opposing and radially directed second support bars 25, which are designed hollow in order to form a second conduit channel 33. The second conduit channels 33 open out into the central conduit 31 of the supply device 30, as clearly illustrated in FIG. 4.

Between the first removal device 21 and the second removal device 22, axially and/or radially offset mixing elements 40 with radially directed support arms 42 are formed on the drill shank 12, on which mixing blades 44 can be arranged.

Below the second removal device 22, an actuating device 50 with a bolt- or plate-shaped actuating element 52 is formed on the drill shank 12, by means of which the center line 31 of the supply device 30 between the first removal device 21 and the second removal device 22 can be shut-off or opened. In FIGS. 3 and 4, the actuating element 52 is shown in the closed or blocked position. One end of the actuating element 52 projects out of the drill shank 12, wherein a radially upwardly directed cam bolt 56 is provided at the outwardly projecting end to form a link adjusting mechanism 54.

The cam bolt 56 engages in a guide groove 59 in an arcuate link rail 58, which is arranged on the outside of the drill shank 12. The guide groove 59 runs in the circumferential direction and is approximately semicircular in shape, but with a varying distance from the drilling axis. This forms the link adjusting mechanism 54, wherein a relative rotation between the link rail 58 with the guide groove 59 and the cam bolt 56 changes the radial position of the latter relative to the drilling axis. The connection between the cam bolt 56 and the actuating element 52 allows the latter to be adjusted between a closed position and an open position by relative rotation.

To effect a relative rotation, the arcuate link rail 58 can be attached to a bearing sleeve 60, which is rotatably mounted on the outside of the drill shank 12. The upper second removal device 22 can also be arranged on the bearing sleeve 60. When the direction of rotation of the drilling tool 10 is changed, a relative rotation can thus be effected between the drill shank 12 and the bearing sleeve 60 with the link rail 58 and, if applicable, the second removal device 22 attached thereto. Thus, the actuating device 50 can be actuated by changing the direction of rotation of the drilling tool 10.

According to a method according to the invention, the actuating element 52 can thus be brought into its open position when creating and deepening a bore with the drilling tool 10, so that in this position drilling fluid or drilling suspension can be guided to the lower first outlet openings 35 during sinking-by-drilling and can be introduced directly into the bore at the first removal device 21.

If, on the other hand, the drilling tool 10 is retracted again from the bore with the direction of rotation reversed, the link adjusting mechanism 54 causes the actuating element 52 to be adjusted into a closed or locked position, so that liquid or suspension then fed is introduced into the bore exclusively via the above-located second outlet openings 36 on the second removal device 22.

The introduction at the upper end of the drilling tool 10 ensures that the rotating drilling tool 10 still admixes the newly introduced fluid sufficiently intensively with the existing suspension in the bore during retraction.

The invention claimed is:

1. A drilling tool for creating a bore in the ground, comprising a tubular drill shank, at least one removal device, which is configured to remove soil material, a supply device for supplying a fluid through the drill shank through at least one outlet opening for the fluid into the bore, and at least one mixing element extending radially to the drill shank, which is arranged on the drill shank at an axial distance from the removal device and is configured for mixing soil material with the fluid, wherein at least one first outlet opening is arranged along the drill shank in the region of the removal device and at least one second outlet opening is arranged along the drill shank at an axial distance from the at least one first outlet opening, wherein at least one actuating device is provided on the supply device, by means of which the at least one first outlet opening and/or the at least one second outlet opening can be blocked, wherein fluid can optionally be introduced into the bore via the at least one first outlet opening and/or the at least one second outlet opening and the at least one first outlet opening and the at least one second outlet opening can alternately be blocked by the at least one actuating device, wherein fluid can be introduced into the bore via the at least one first outlet opening and/or the at least one second outlet opening, while the at least one second outlet opening or rather the at least one first outlet opening is blocked.

2. The drilling tool according to claim 1, wherein at least one first removal device is arranged at a lower end portion of the drill shank and at least one second removal device is arranged axially above the first removal device.

3. The drilling tool according to claim 2, wherein the at least one mixing element is arranged between the first removal device and the second removal device.

4. The drilling tool according to claim 1, wherein the removal device has at least one support bar extending radially to the drill shank, on which removal elements for removing soil material are arranged, and a first conduit channel is formed on or in the support bar, along which further outlet openings are provided.

5. The drilling tool according to claim 4, wherein the mixing element has a support arm and a second conduit channel is formed on or in the support arm, along which further outlet openings are provided.

6. The drilling tool according to claim 5, wherein the actuating device comprises at least one movable actuating element which can be adjusted between a closed setting and an open setting.

7. The drilling tool according to claim 6, wherein an actuating element is assigned to each of the first conduit channel and the second conduit channel.

8. The drilling tool according to claim 6, wherein the at least one actuating element is mechanically adjustable by means of a link adjusting mechanism.

9. The drilling tool according to claim 1, wherein at least one outlet opening is arranged directly on the drill shank.

10. The drilling tool according to claim 1, wherein the actuating device can be operated by changing the rotation of the drill shank.

11. A method for creating a bore in the ground,
wherein
a drilling tool according to claim 1 is used and
a fluid is optionally introduced into the bore via at least one first outlet opening and/or at least one second outlet opening.

12. The method according to claim 11,
wherein
during sinking-by-drilling the fluid is introduced via the at least one first outlet opening, which is arranged in a lower end portion of the drill shank, and
the fluid is introduced into the bore via the at least one second outlet opening above the first outlet opening, wherein the drilling tool is rotated.

13. The method according to claim 11,
wherein
a curable suspension is introduced as the fluid,
wherein a foundation element is produced in the bore in the ground.

* * * * *